US005628209A

United States Patent [19]

Ikegami

[11] Patent Number: 5,628,209

[45] Date of Patent: May 13, 1997

[54] METHOD OF FORMING A KNOT ON A FLAT KNITTING MACHINE

[75] Inventor: Takashi Ikegami, Nakanoshima, Japan

[73] Assignee: Shima Seiki Manufacturing Ltd., Wakayama, Japan

[21] Appl. No.: 521,476

[22] Filed: Aug. 30, 1995

[30] Foreign Application Priority Data

Sep. 1, 1994 [JP] Japan ..... 6-208521

[51] Int. Cl.[6] ..... D04B 7/00

[52] U.S. Cl. ..... 66/60 R

[58] Field of Search ..... 66/60 R, 64, 69, 66/70, 71, 75.1, 76, 77, 172 R, 179

[56] References Cited

U.S. PATENT DOCUMENTS 3,057,177 10/1962 Alric ..... 66/89
4,548,057 10/1985 Essig ..... 66/172 R
5,271,249 12/1993 Mitsumoto et al. ..... 66/60 R
5,467,616 11/1995 Loquet et al. ..... 66/60 R
5,476,616 12/1995 Loquet et al. ..... 66/60

FOREIGN PATENT DOCUMENTS

4308275A1 3/1993 Denmark .
0616064A1 3/1994 European Pat. Off. .

OTHER PUBLICATIONS

International Publication No. WO92/05304 published Apr. 2, 1992.

*Primary Examiner*—C. D. Crowder
*Assistant Examiner*—Larry D. Worrell, Jr.
*Attorney, Agent, or Firm*—Nikaido, Marmelstein, Murray & Oram LLP

[57] ABSTRACT

Empty-needle-knitting is made on an empty needle D, then a yarn feeder 2 is reversed to change the direction of the yarn, and the stitch is transferred to the opposing bed to form a loop. A knit stitch is formed on the formed loop, and the loop is knocked over to form a knot. The knot is made to overlap with a stitch of the knitted fabric, and in a subsequent course, the knot is held to the knitted fabric.

4 Claims, 11 Drawing Sheets

METHOD OF FORMING A KNOT ON A FLAT KNITTING MACHINE

SPECIFICATION

1. Field of Industrial Application

The present invention relates to a method of forming a knot with the use of a flat knitting machine.

2. Prior Art

In producing knitted fabrics with a flat knitting machine, it is necessary to form a knot to prevent knitted fabrics from running every time when a new yarn is used for knitting or when knitting with one specific yarn is completed. The formation of a knot is done manually and is inefficient. European Patent No. 616,064-A1, which was published after the priority date of the present invention, discloses knitting courses for forming stitches on a flat knitting machine.

SUMMARY OF THE INVENTION

One object of the present invention is to provide a new method of forming a knot on a flat knitting machine.

Another object of the present invention is to form knot with minimal courses.

Another object of the present invention is to make a knot inconspicuous.

Still another object of the present invention is to hold a knot in any desired position.

The present invention uses a flat knitting machine which has at least a pair of needle beds abutting to each other, which is capable of transferring a yarn between needle beds, and which is capable of racking needle beds relative to each other, and is characterized by the following steps, a: a step of feeding a yarn from a yarn feeder to an empty needle of one needle bed and hooking the yarn by said needle;

b: a step of reversing the yarn feeder and shifting the yarn feeder beyond said needle;

c: a step of transferring the yarn being hooked by said needle to an empty needle of another needle bed to form a loop;

d: a step of feeding the yarn from the yarn feeder to said needle to which transfer was made to form a stitch, and of knocking over said transferred loop to form a knot;

e: a step of overlapping said knot with a stitch of the knitted fabric to make a double stitch; and f: a step of forming another stitch on said double stitch to fix said knot onto the knitted fabric.

In the present invention, a yarn is fed to an empty needle, the yarn is hooked by the needle, then the yarn feeder is reversed to change the direction of the yarn, and the yarn is transferred to the opposite bed. As a result, the hooked yarn forms a loop. A next stitch is produced on the formed loop, then the loop is knocked over to form a knot in the lower part of the stitch. In the subsequent steps, the knot is placed over a stitch of the knitted fabric, and the knot is held to the knitted fabric by another course. The number of courses needed is small , and the knot is formed by minimal courses.

As described above, a knot can be formed by a minimal number of courses. The knot, after the excess yarn is tightened and cut off, is sunken beneath the other stitch placed over the knot, and is inconspicuous; thus a clear pattern boundary can be formed on the knitted fabric. Moreover, the knot may be held in any places other than the boundary of a pattern. When the knot is located inside the pattern, the knot does not disturb the pattern.

BRIEF DESCRIPTION OF THE DRAWINGS

FIG. 2 and FIG. 3: Knitting course diagrams showing the formation of a knot for introducing a new yarn. A through I in the diagrams show needles of a front bed, and a through i show needles of a back bed. 1P indicates a racking by one pitch. The needles A through C corresponds to the knitting area Q, needles D through F to the knitting area P, and needles G through I to the knitting area R, respectively.

FIG. 4: The diagrams show the formation of a knot by the knitting courses shown in FIG. 2 and FIG. 3.

FIG. 6 and FIG. 7: Knitting course diagrams showing the formation of a knot for terminating a yarn in the embodiment.

FIG. 8: The diagrams show the formation of a knot by the knitting courses shown in FIG. 6 and FIG. 7.

FIG. 10: Knitting course diagrams showing the formation of a knot for introducing a new yarn in an optimal embodiment.

FIG. 11: Knitting course diagrams showing the formation of a knot for terminating a yarn in the optimal embodiment.

EMBODIMENT

Figure 1:
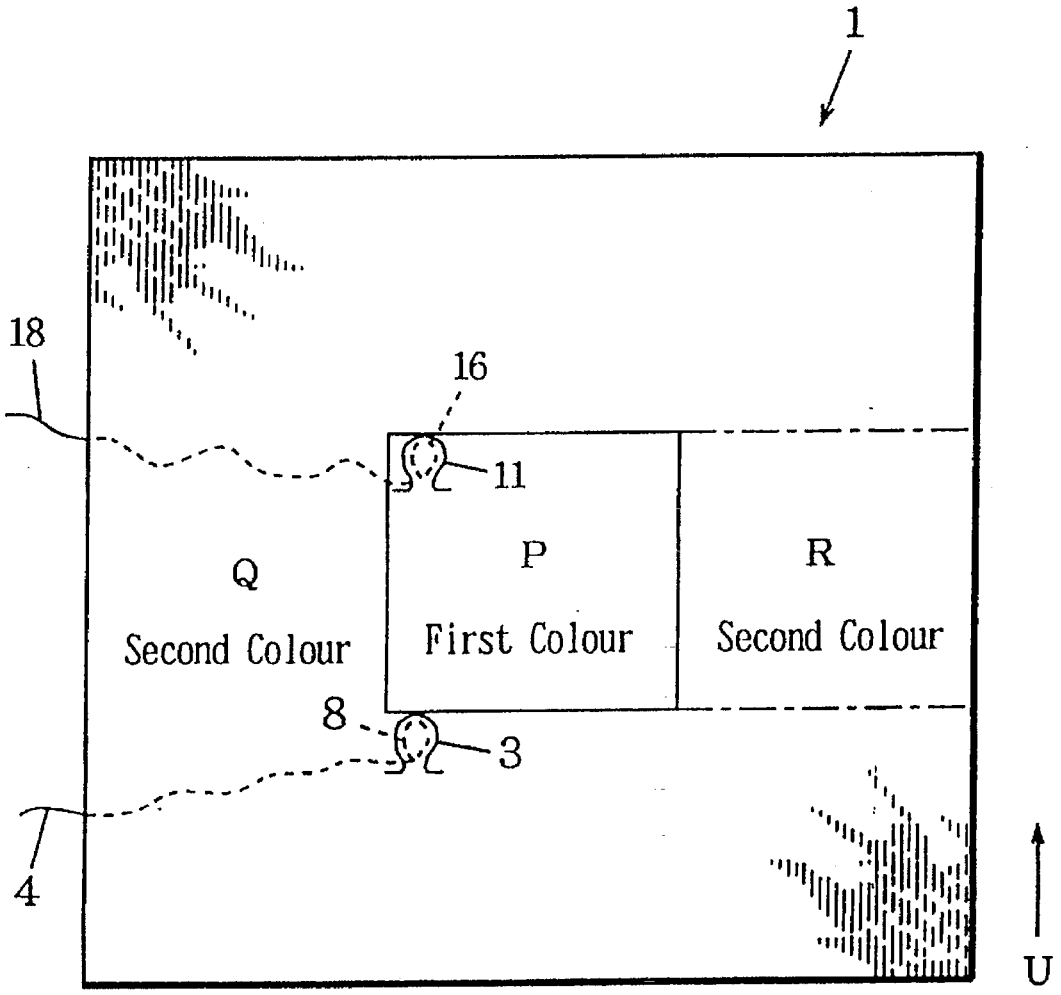
FIG. 1: A diagram showing the point at which a new yarn is introduced and the point at which the yarn is terminated in an embodiment. The diagram also shows knitting areas P, Q and R.

FIG. 1 through FIG. 9 show an embodiment. The embodiment shows both the introduction of a yarn and the termination of a yarn. The embodiment may be applied to either the introduction of a yarn or the termination of a yarn. As shown in FIG. 1, a knitted fabric 1 having three knitting areas P, Q and R is to be intarsia-knitted. The first color is allotted to the area P, and the second color is allotted to the areas Q and R. For intarsia-knitting, different yarns of the same color are allotted to the areas Q and R. The introduction of a yarn and the termination of the yarn are needed at the starting points and finishing points of the respective knitting areas P, Q and R. One knot is needed for every introduction or termination of a yarn. The present embodiment shows formation of a knot at the starting point and at the terminating point of the knitting area P.

In FIG. 1, 3 denotes a stitch of the area Q, the stitch being immediately before the area P. 8 denotes a knot of the yarn introducing part of the area P, the knot overlapping with the stitch 3. 4 is excess yarn from the knot 8 to a yarn end holder not illustrated. 11 is a stitch of the last course of the area P. 16 is a knot of the yarn terminating part, the knot overlapping with the stitch 11. 18 is excess yarn from the knot 16. The knitting proceeds from the bottom end of FIG. 1 in the direction of the arrow U, and the area Q is knitted just immediately before the area P and the area R.

Figure 2A:
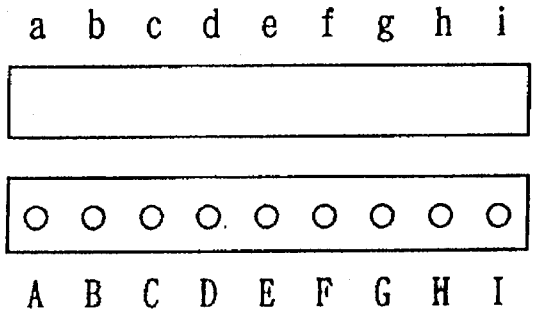
FIG. 2A shows a stitch row of the area Q being held on needles A through I.
Figure 2B:
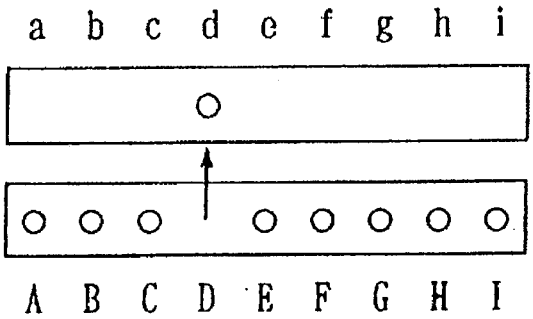
FIG. 2B shows transferring a stitch on the needle D to the needle d.
Figure 2C:
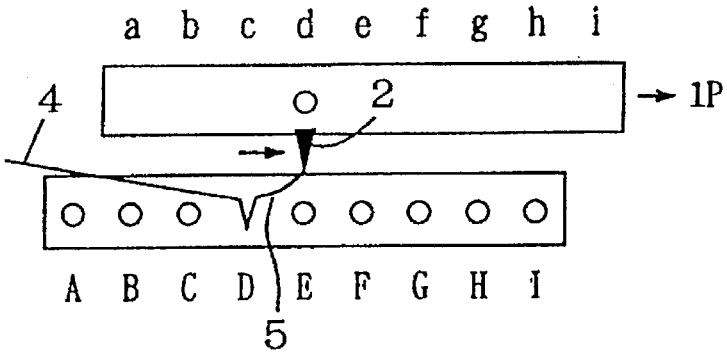
FIG. 2C shows hooking the yarn of the knitting area P on the needle D.

For the convenience of description, each diagram shows a smaller number of needles than those actually used. A, B, C, . . . indicate needles of the front bed. a, b, c, . . . indicate needles of the back bed. The case of introducing a yarn is shown in FIG. 2 and FIG. 3. Just when knitting of the stitch 3 is completed, the needle beds are in the state shown in FIG. 2A. During the course shown in FIG. 2B, for example, a stitch of the needle D is transferred to the needle d of the opposing bed. In the next course shown in FIG. 2-3, the back bed is racked, for example, by a pitch of one needle in the direction away from the excess yarn 4. Then the yarn feeder 2 is moved to feed a yarn 5 to the empty needle D. As a result, the yarn 5 is hooked on the needle D (FIG. 4A). Feeding a yarn to an empty needle is called empty needle knitting, and the hooked yarn is assumed to be a stitch and is called a stitch of empty needle knitting.

Figure 2D:
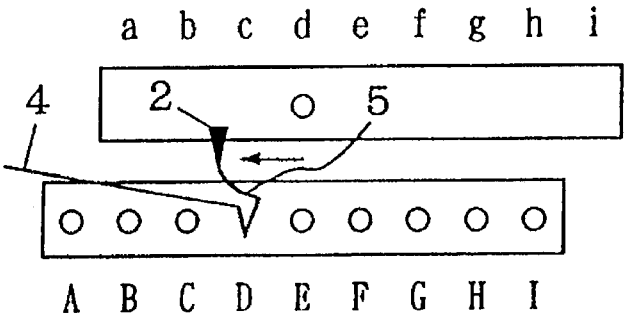
FIG. 2D shows reversing the yarn feeder.
Figure 3A:
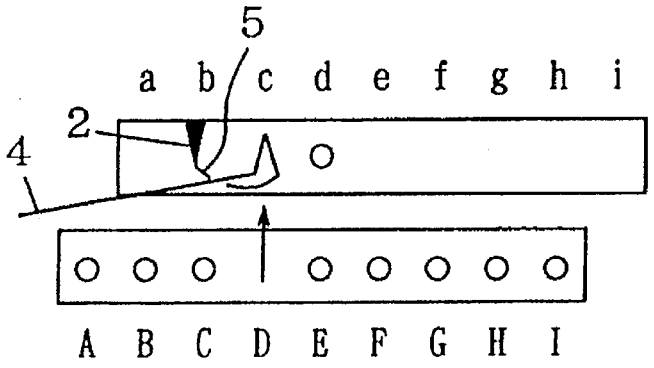
FIG. 3A shows formation of a stitch by transferring the yarn being hooked on the needle D to the needle c.
Figure 3B:
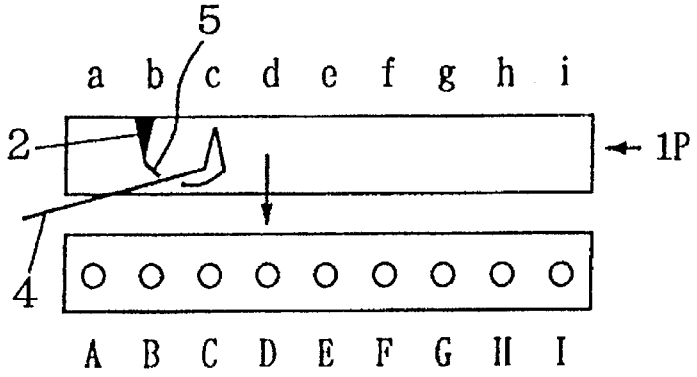
FIG. 3B shows retransferring the stitch from the needle d to the needle D.
Figure 3C:
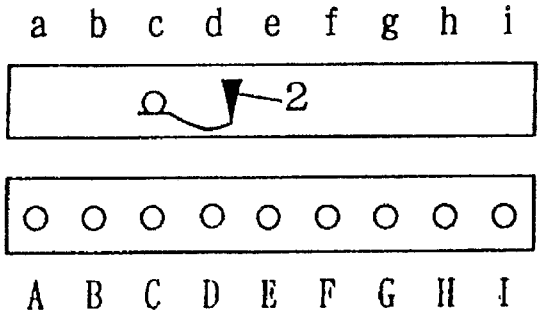
FIG. 3C shows formation of a new stitch on the needle c and formation of a knot from the original stitch.
Figure 4D:
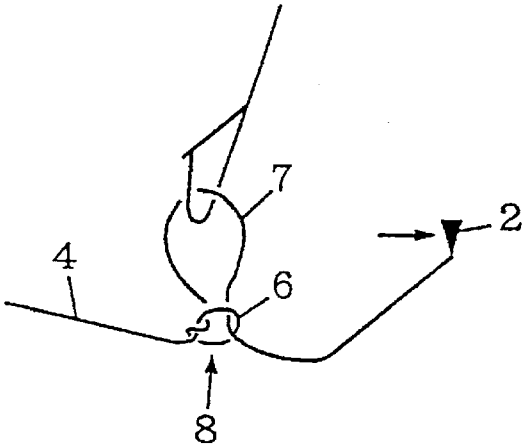
FIG. 4D corresponds to FIG. 3C.
Figure 4C:
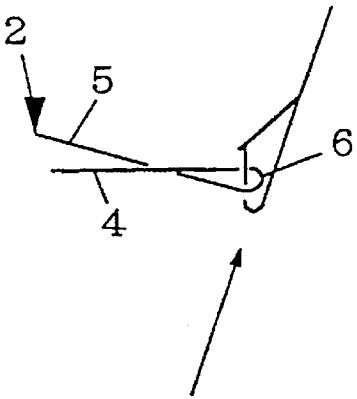
FIG. 4C corresponds to FIG. 3A.
Figure 4B:
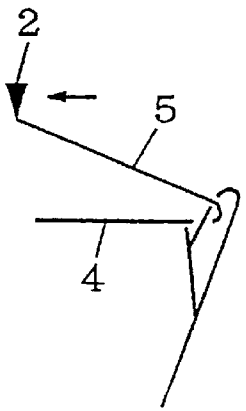
FIG. 4B corresponds to FIG. 2D.

In the next course of FIG. 2D, the yarn feeder 2 is reversed and moved to the left side of the needle D. As a result, the condition of the yarn on the needle D becomes as shown in FIG. 4B. Next, in the course as shown in FIG. 3A, the stitch of the empty needle knitting on the needle D is transferred to the needle c. Then, as a result of the transfer, the excess yarn 4 is located above the yarn 5. Thus the stitch of the empty needle knitting is twisted to form a loop 6 (FIG. 4C). In the next course as shown in FIG. 3B, the back bed is racked towards the left by one needle, then the stitch 3 is transferred from the needle d back to the needle D. Then, in the next course as shown in FIG. 3C, the yarn feeder 2 is reversed to feed the yarn to the needle c. In this process, the yarn 5 being located beneath the excess yarn 4 is turned back to go over the excess yarn 4, and a stitch 7 is formed on the needle c by knitting operation. At the same time, the stitch 6 of empty needle knitting is knocked over from the needle c, and a knot 8 is formed by the stitch 7 and the stitch 6 of empty needle knitting (FIG. 4D).

Figure 3D:
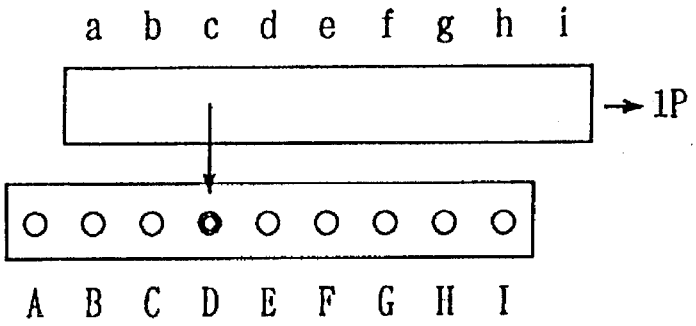
FIG. 3D shows overlapping the formed knot with the stitch on the needle D.
Figure 4A:
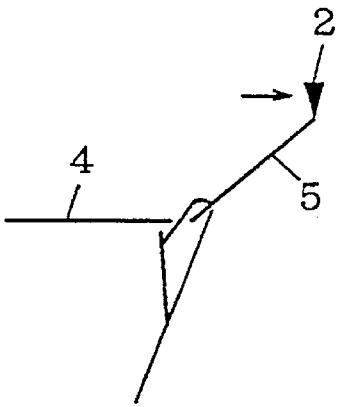
FIG. 4A corresponds to FIG. 2C.

Next, in the course as shown in FIG. 3D, the back bed is racked towards the right by one needle, then the knot 8 is transferred, for example, to the needle D. As a result, the stitch 7 is overlapped with the stitch 3 of the area Q to form a double stitch. After that, the yarn is fed from the yarn feeder 2 to the needles D through F of the front bed to knit the area P. When a stitch of the next course of the area P is formed on the double stitch comprising the stitch 3 and the stitch 7, the knot is fixed on to the knitted fabric.

Figure 5:
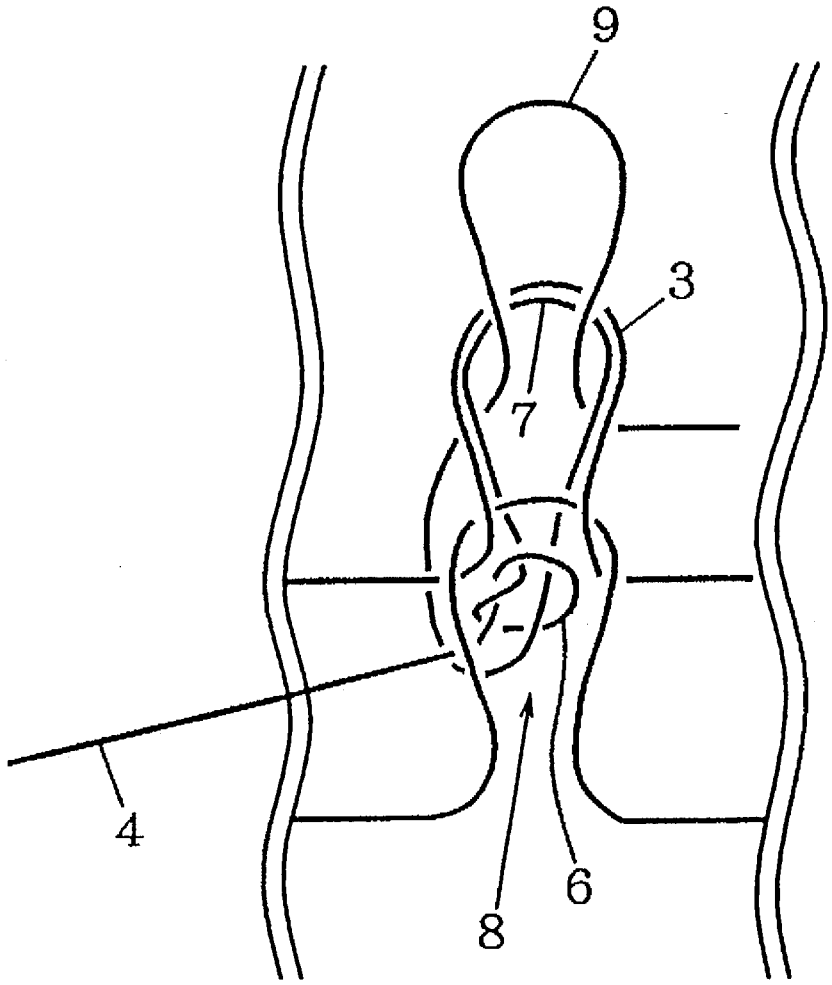
FIG. 5: A partial diagram showing loops after the introduction of a yarn in the embodiment.

The state of the knot 8 after knitting the area P is shown in FIG. 5. The knot 8 overlaps with the stitch 3, and is retained in position by a stitch 9 of the first course of the area P. The knitted fabric 1 is removed from the flat knitting machine. The excess yarn 4 is pulled out and the knot 4 is tightened. Then the excess yarn 4 is cut off near the knitted fabric. Thus the treatment of the yarn introducing part is completed.

One of the important points in forming the knot 8 is the formation of a loop by empty-needle-knitting on an empty needle, reversing the yarn feeder to change the direction of the yarn, and transferring the stitch to the opposite bed. Then the next knit stitch is formed on the loop formed, and the above-mentioned loop is knocked over to form a knot in the lower part of the knit stitch. Next, the knot is overlapped with a stitch of the knitted fabric, and in a subsequent course, the knot is held onto the knitted fabric. The required number of courses is small as clearly shown in FIG. 2 and FIG. 3. Thus with a minimal number of courses, a knot can be formed.

When the excess yarn 4 is cut off, as the stitch 7 has been tightened up, the stitch 7 sets beneath the stitch 3. Thus the stitch 3 comes to the surface of the knitted fabric 1. As a result, the knot 8 is inconspicuous, and the boundary of the pattern can be seen clearly. The knot 8 can be made to overlap with any stitch desired. For instance, after the formation of the knot 8, an appropriate number of courses of the area 8 may be knitted, and the knot 8 may be made to overlap with a stitch of the area P. In this case, the knot 8 overlaps with a stitch of the same color, and the pattern of the knitted fabric 1 can be seen more clearly. The knot 8 may be formed, for example, several courses before the start of knitting the area P, the formed knot 8 may be held on a needle which is not used in knitting, and later the knot 8 may be made to overlap with a stitch of the area P.

With reference to FIG. 6 through FIG. 9, the termination of the yarn will be explained. In the case of yarn introduction, when a stitch once transferred to the needle d is to be transferred back to the needle D, it is necessary to keep the excess yarn 4 from interfering the process. Hence the back bed has to be racked towards the left in FIG. 2C. In the case of yarn termination, however, there is no need of considering the excess yarn from the yarn feeder. Thus racking can be made in either direction. Suppose the knitted fabric 1 of FIG. 1 has been knitted up to the last stitch 11 of the area P. At that point, as shown in FIG. 6-1, the stitches of the area Q are hooked on the needles A through C, the stitches of the area P on the needles D through F, and the stitches of the area R on the needles G through I, respectively. Next, in the course of FIG. 6B, the stitch 11 held on the needle D is transferred to the needle d. Next, in the course of FIG. 6C, the back bed is racked towards the right by, for example, one needle. Then a yarn 12 is fed from the yarn feeder 2 to the empty needle D. 13 is a prolonged yarn to the stitch held on the needle d. The stitch of empty-needle-knitting thus obtained is shown in FIG. 8A.

Figure 6A:
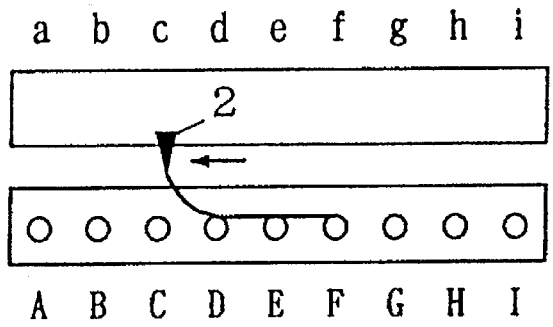
FIG. 6A shows knitting the last course of the area P.
Figure 6B:
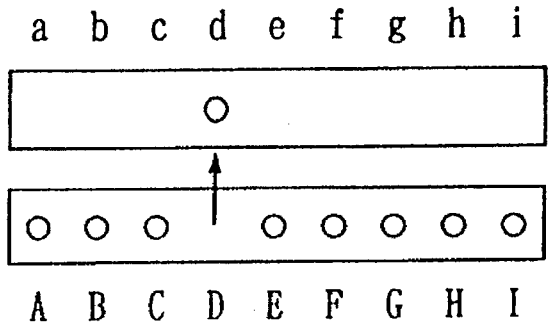
FIG. 6B shows transferring a stitch on the needle D to the needle d.
Figure 6C:
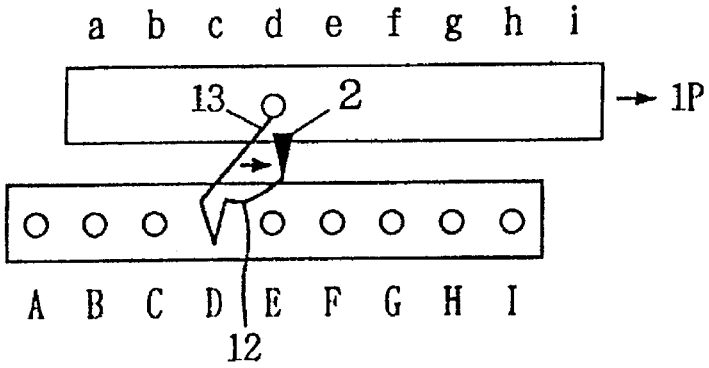
FIG. 6C shows hooking the yarn on the needle D.
Figure 6D:
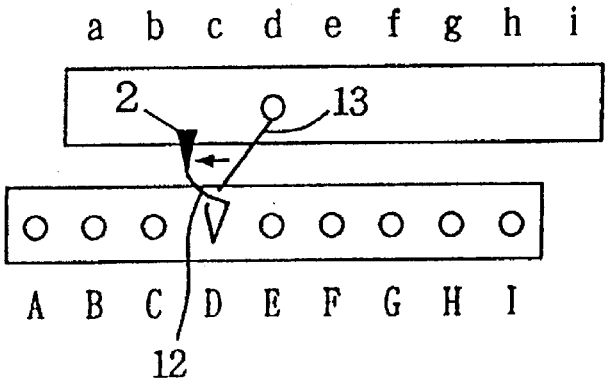
FIG. 6D shows reversing the yarn feeder.
Figure 8D:
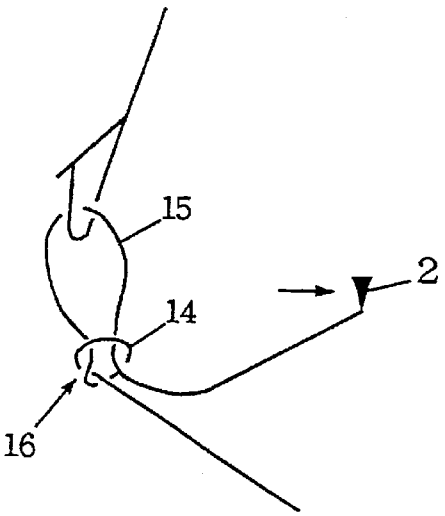
FIG. 8D corresponds to FIG. 7C.
Figure 8C:
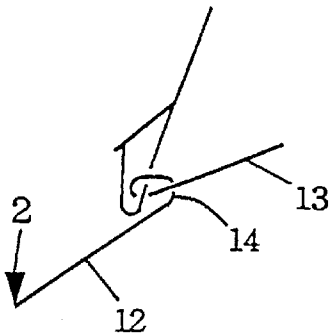
FIG. 8C corresponds to FIG. 7A.
Figure 8B:
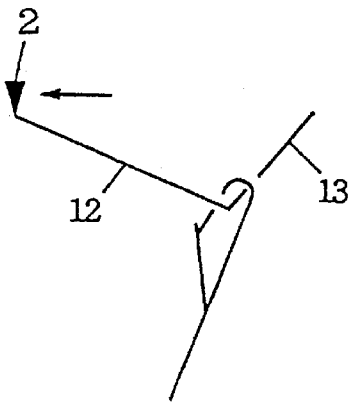
FIG. 8B corresponds to FIG. 6D.
Figure 8A:
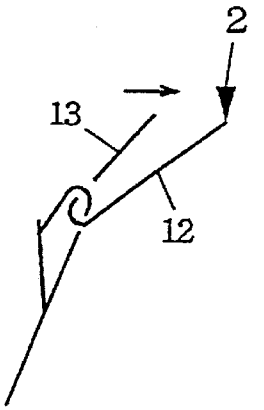
FIG. 8A corresponds to FIG. 6C.

Next, in the course as shown in FIG. 6D, the yarn feeder 2 is reversed, and as shown in FIG. 8B, the yarn feeder 2 is shifted to the left beyond the needle D. In the course of the next FIG. 7A, the stitch of empty-needle knitting on the needle D is transferred to the opposing needle c. The transferred state is shown in FIG. 8C; the excess yarn from the stitch 11 to the needle c is located above the yarn 12, and the stitch of empty-needle-knitting is twisted to form a loop 14.

Figure 7A:
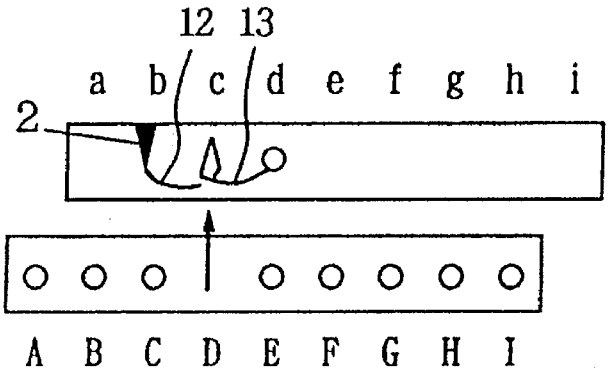
FIG. 7A shows formation of a stitch by transferring the yarn being hooked on the needle D to the needle c.
Figure 7B:
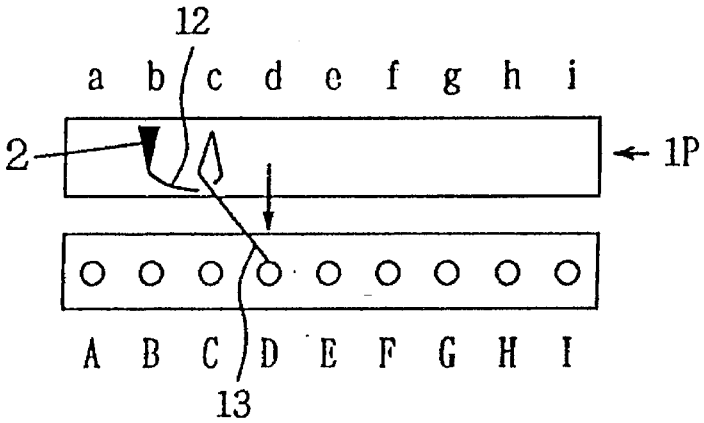
FIG. 7B shows retransferring the stitch from the needle d to the needle D.
Figure 7C:
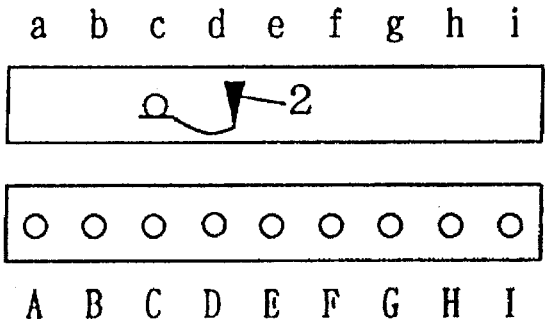
FIG. 7C shows formation of a new stitch on the needle c and formation of a knot from the original stitch.
Figure 7D:
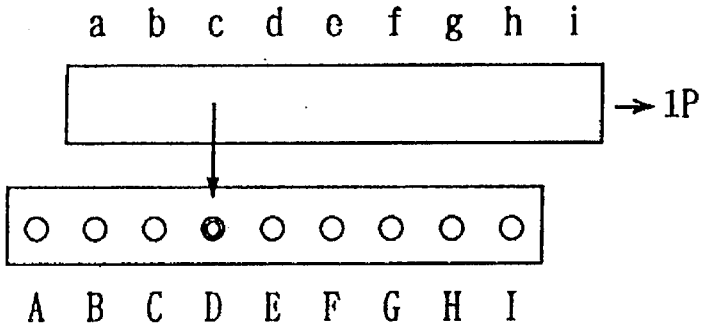
FIG. 7D shows overlapping the formed knot with the stitch on the needle D.
Figure 9:
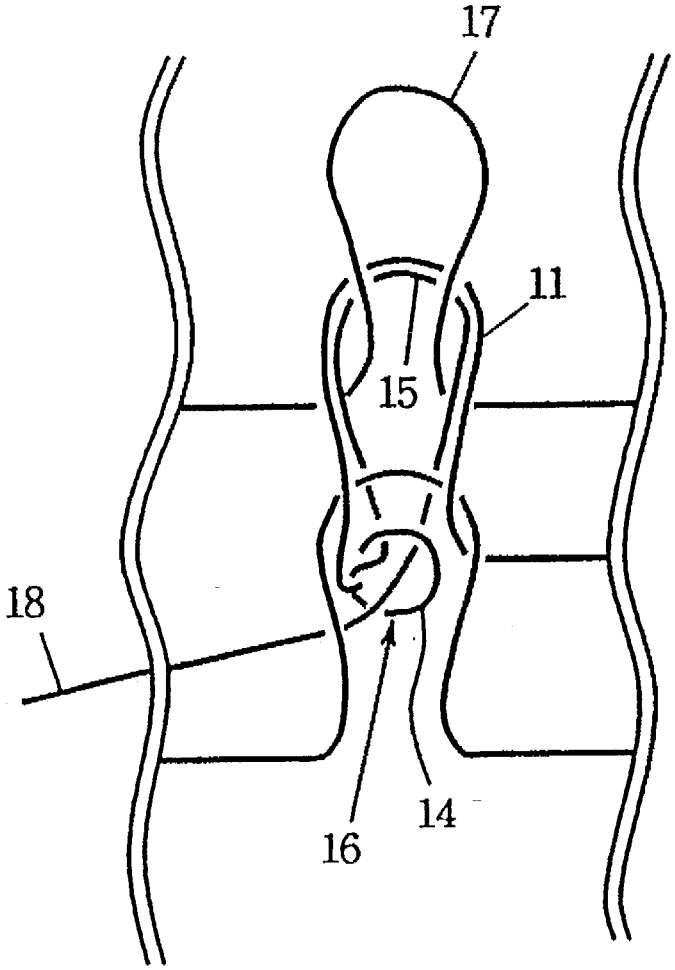
FIG. 9: A partial diagram showing loops after the termination of the yarn in the embodiment.
Figure 10A:
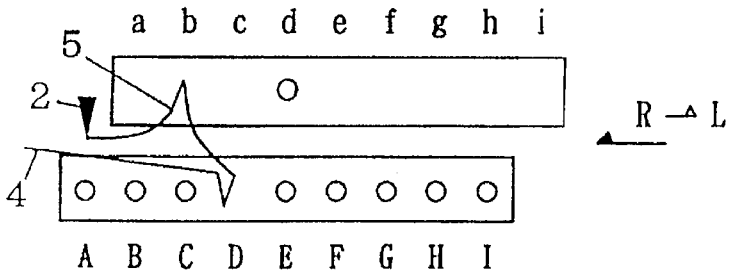
FIG. 10A follows FIG. 2C and shows hooking the yarn on the needle D and tacking the yarn to the needle b.
Figure 10B:
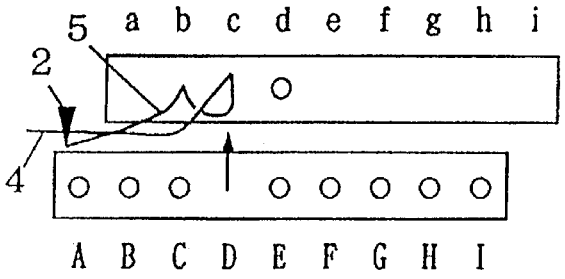
FIG. 10B shows transferring the stitch on the needle D to the needle c.
Figure 10C:
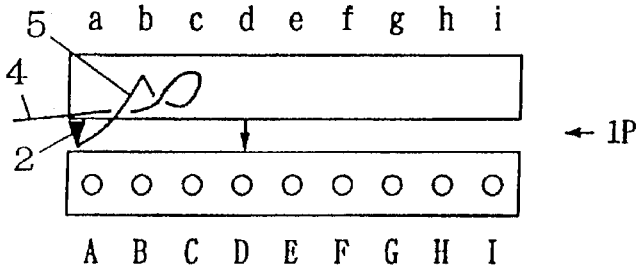
FIG. 10C shows retransferring the stitch from the needle d to the needle D.
Figure 10D:
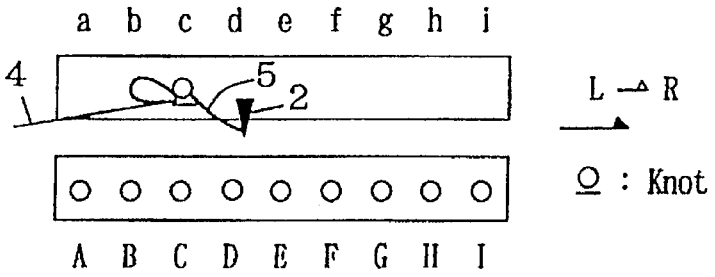
FIG. 10D shows formation of a knot by forming a new stitch on the needle c.
Figure 10E:
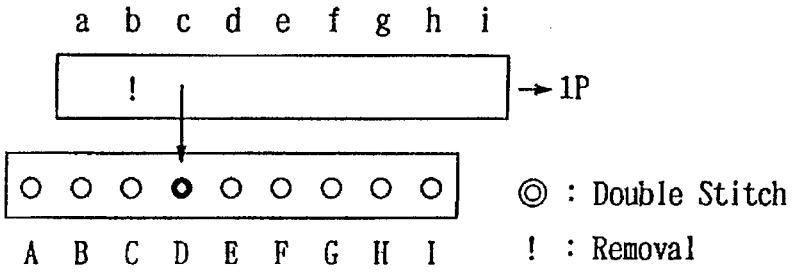
FIG. 10E shows transferring the knot to the needle D and the treatment of the yarn being tacked to the needle b.
Figure 11A:
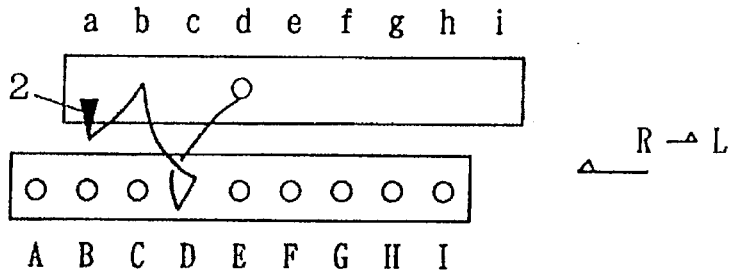
FIG. 11A follows FIG. 6C, and shows hooking the yarn on the needle D and tacking to the needle b.
Figure 11B:
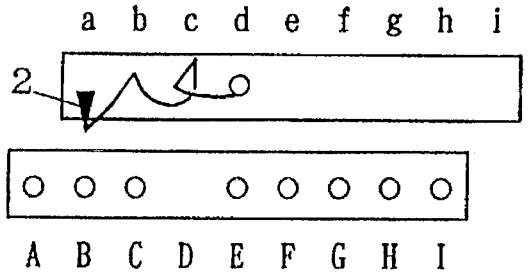
FIG. 11B shows transferring from the needle D to the needle c.
Figure 11C:
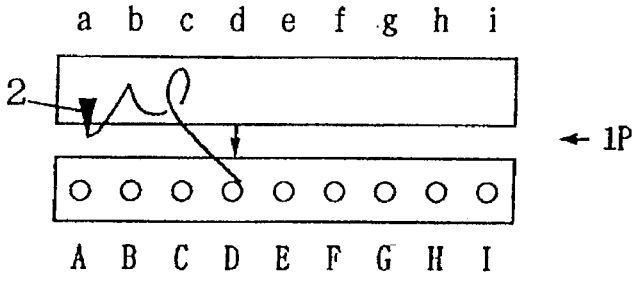
FIG. 11C shows retransferring the stitch from the needle d to the needle D.
Figure 11D:
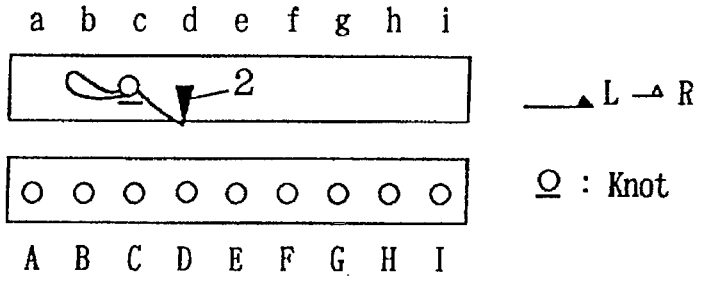
FIG. 11D shows formation of a knot by forming a new stitch on the needle c.
Figure 11E:
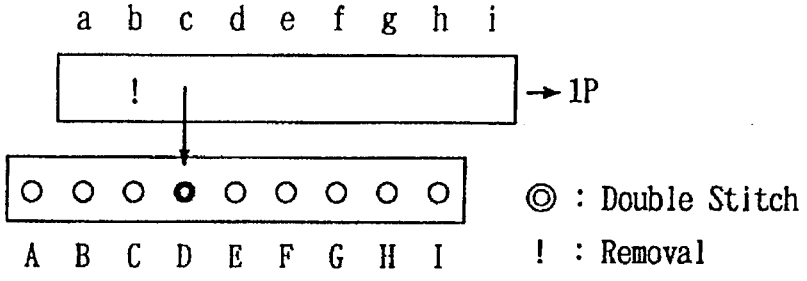
FIG. 11E shows shifting the knot to the needle D and treatment of the yarn tacked to the needle b.

Next, in the course of FIG. 7B, the back bed is racked to the left by one needle, then the stitch 11 on the needle d is transferred back to the needle D. In the course of the next FIG. 7C, the yarn feeder 2 is reversed, and the yarn 12 is fed to the needle c on which the loop 14 is hooked. At this time, the yarn 12 lying beneath the excess yarn 13 is folded back and goes over the excess yarn 13 to form a stitch 15 by knitting operation. As a result, the loop 14 is knocked over and a knot 16 is formed at the root of the stitch 15. In the course of the next FIG. 7D, the back bed is racked to the right by one needle. After that, the stitch 15 is transferred, for example, to the needle D, and the knot 16 is made to overlap with the stitch 11 to form a double stitch. After that, a stitch 17 of the area Q shown in FIG. 9 is formed on the double stitch to hold the double stitch onto the knitted fabric. The state of the knot 16 and around are shown in FIG. 9. The knitted fabric 1 is removed from the flat knitting machine. Then the excess yarn 18 between the yarn end and the knitted fabric is pulled out from the knitted fabric 1. The knot 16 is tightened up, and the excess yarn 18 is cut off near the knot 16.

The present invention is not limited to knitting of intarsia knitted fabrics. For instance, it may be applied to yarn introduction and yarn termination for forming a pocket on a body part. In the embodiment, the explanation was given for a flat knitting machine having two beds. When a flat knitting machine with four beds is used, for example, a knitted fabric is knitted on a front lower bed, and empty-needle-knitting is made on a front upper bed. Stitches of empty-needle-knitting are transferred to a remaining back upper bed or a remaining back lower bed. With this arrangement, the courses of FIG. 2A, FIG. 2B, FIG. 6A and FIG. 6B can be eliminated. Moreover, when a flat knitting machine with two beds is used, if the needle D of FIG. 2 and FIG. 6 is empty at the beginning, the courses of FIG. 2A, FIG. 2B and FIG. 6A and FIG. 6B can be omitted. Furthermore, when the flat knitting machine is provided with a mechanism for tightening a knot and cutting off excess yarn, the process of pulling out and cutting off the excess yarn will be automatized.

OPTIMAL EMBODIMENT

An optimal embodiment is shown in FIG. 10 and FIG. 11. If the loop 6 or 14 held on the needle c comes to the top end of the hook of the needle c, it is hard to form knot 8 or 16. Hence, in the present embodiment, to prevent the loop 6 or 14 from coming to the top end of the hook, tucking is made to the nearby needle b. When the knot 8 or 16 is transferred back to the needle D, the tucked stitch is removed. The knot thus obtained is identical to the knot 8 or 16 of the embodiment of FIG. 2 through FIG. 9.

FIG. 10A through FIG. 10E show the yarn introducing processes. After the processes up to those of FIG. 2C are completed, tucking is made to the needle b in the course of FIG. 10A. In the next course of FIG. 10B, the stitch of empty-needle-knitting of the needle D is transferred to the needle c, and in the next course of FIG. 10-3, the stitch on the needle d is transferred back to the original needle D. Next, in the course of FIG. 10D, the stitch 7 is formed on the needle c to from the knot 8, and in the course of FIG. 10E, the knot 8 is made to overlap with the stitch 3 on the needle D, and at the same time, the stitch being tucked to the needle b is removed. Other points are similar to those of the embodiment of FIG. 2 through FIG. 5.

FIG. 11A through FIG. 11E show the processes of yarn termination. After the processes of up to FIG. 6-3 are completed, in the course of FIG. 11A, tucking is made to the needle b. In the next course of FIG. 11B, the stitch of empty-needle-knitting on the needle D is transferred to the needle c. In the next course of FIG. 11C, the stitch on the needle d is transferred back to the original needle D. In the next course of FIG. 11E, the knot 8 is made to overlap with the stitch 3 on the needle D, and at the same time, the stitch being tucked to the needle b is removed. Other points are similar to those of the embodiment of FIG. 6 through FIG. 9. The treatment is similar to the yarn introduction of FIG. 10 except there is no excess yarn but there is a knot 11 in place of it.

I claim:

1. A method of forming a knot on a flat knitting machine having at least a yarn feeder and at least a pair of needle beds, each having a plurality of needles and abutting to each other and configured to transfer a yarn between needle beds, said flat knitting machine also being configured to rack needle beds relative to each other, said method comprising the steps of a) feeding a yarn from the yarn feeder to an empty first needle of a first needle bed of said pair of needle beds by moving the yarn feeder past said first needle in a first direction to a first position and hooking the yarn by said needle;

b) reversing the yarn feeder by moving the yarn feeder in a second, opposite direction and shifting the yarn feeder past said needle to a second position;

c) transferring the yarn being hooked by said needle to an empty second needle of a second needle bed of said pair of needle beds to form a first loop;

d) feeding the yarn from the yarn feeder to said second needle to which transfer was made to form a second loop, and knocking over said first loop to form a knot out of said first and second loops;

e) overlapping said knot with a loop of the knitted fabric to form a double loop; and f) forming another loop on said double loop to fix said knot onto the knitted fabric.

2. A method of forming a knot on a flat knitting machine as recited in claim 1, wherein said first needle of said first needle bed is made empty by transferring a loop from said first needle of said first needle bed, to which said loop is being hooked, to a third needle of the second needle bed.

3. A method of forming a knot on a flat knitting machine as recited in claim 1, wherein excess yarn is pulled out from the knitted fabric to tighten said knot and then the excess yarn is cut off near the knitted fabric.

4. A method of forming a knot on a flat knitting machine as recited in claim 1, wherein in said step b), the yarn is tucked to an empty needle of the second needle bed, and in said step e), the yarn being tucked is removed from the needle to which tucking was made in the step b).

* * * * *